US006566847B1

(12) United States Patent
Chou et al.

(10) Patent No.: US 6,566,847 B1
(45) Date of Patent: May 20, 2003

(54) LOW POWER CHARGE PUMP REGULATING CIRCUIT

(75) Inventors: Shao-Yu Chou, Chung Li (TW); Yue-Der Chih, Hsin-chu (TW); Hung-Wen Chang, Miaoli (TW)

(73) Assignee: Taiwan Semiconductor Manufacturing Company, Hsin-Chu (TW)

( * ) Notice: Subject to any disclaimer, the term of this patent is extended or adjusted under 35 U.S.C. 154(b) by 0 days.

(21) Appl. No.: 10/207,550

(22) Filed: Jul. 29, 2002

(51) Int. Cl.[7] ..... G05F 1/46
(52) U.S. Cl. ..... 323/282; 363/59
(58) Field of Search ..... 323/282, 284, 323/285, 351; 363/59, 60; 327/536

(56) References Cited

U.S. PATENT DOCUMENTS

| | | | | | |
|---|---|---|---|---|---|
| 5,086,238 | A | * | 2/1992 | Watanabe et al. | 327/539 |
| 5,394,365 | A | | 2/1995 | Tsukikawa | 365/189.09 |
| RE35,041 | E | * | 9/1995 | Rossi et al. | 327/109 |
| 5,483,486 | A | * | 1/1996 | Javanifard et al. | 365/185.17 |
| 5,553,030 | A | | 9/1996 | Tedrow et al. | 365/226 |
| 5,671,179 | A | | 9/1997 | Javanifard | 365/185.33 |
| 5,726,944 | A | | 3/1998 | Pelley, III et al. | 365/226 |
| 5,781,473 | A | | 7/1998 | Javanifard et al. | 365/185.18 |
| 5,812,017 | A | | 9/1998 | Golla et al. | 327/536 |
| 5,831,469 | A | * | 11/1998 | Menichelli | 327/536 |
| 6,111,470 | A | * | 8/2000 | Dufour | 331/17 |
| 6,177,828 | B1 | * | 1/2001 | Kang et al. | 327/536 |
| 6,255,873 | B1 | * | 7/2001 | Johnson et al. | 327/157 |

* cited by examiner

*Primary Examiner*—Adolf Daneke Berhane
(74) *Attorney, Agent, or Firm*—George O. Saile; Stephen B. Ackerman; Larry J. Prescott

(57) ABSTRACT

A charge pump voltage regulating circuit which uses a constant current generator and a second current generator, controlled by the output voltage of the charge pump circuit. The current from the constant current generator is divided between the input to a current controlled oscillator and the second current generator. When the output voltage of the charge pump circuit increases the current in the second current generator increases, the current flowing into the current controlled oscillator decreases, the frequency of the clock signals supplied to the charge pump circuit decreases, and the output voltage of the charge pump circuit decreases. When the output voltage of the charge pump circuit decreases the current in the second current generator decreases, the current flowing into the current controlled oscillator increases, the frequency of the clock signals supplied to the charge pump circuit increases, and the output voltage of the charge pump circuit increases.

27 Claims, 4 Drawing Sheets

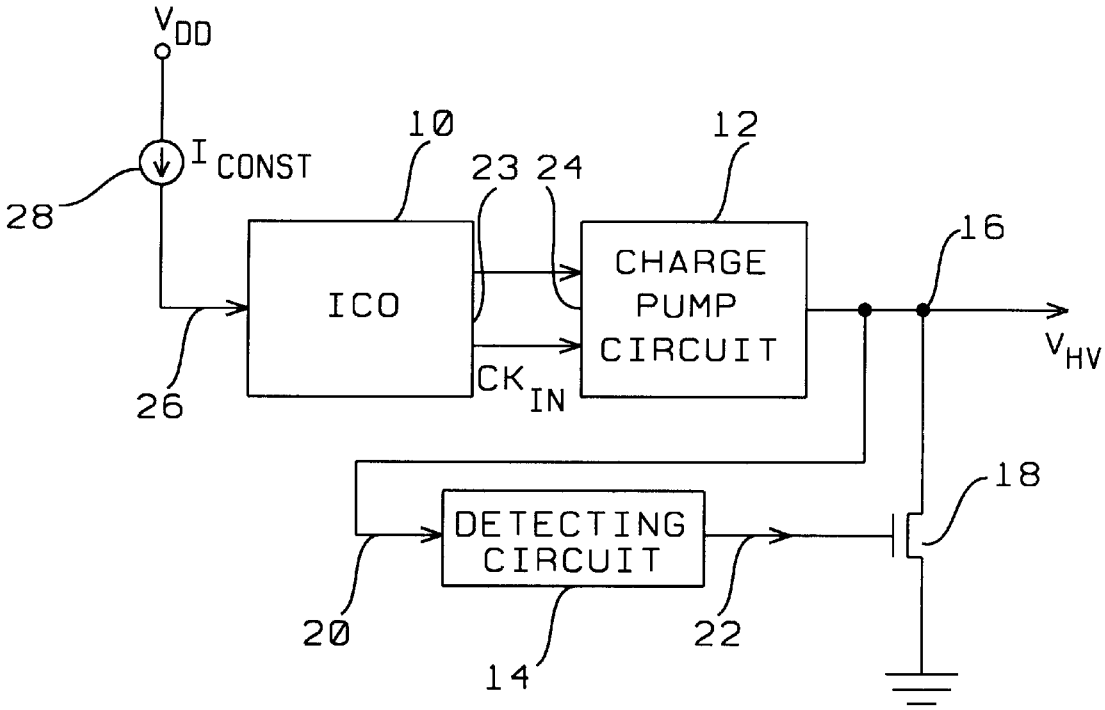
FIG. 1 – Prior Art
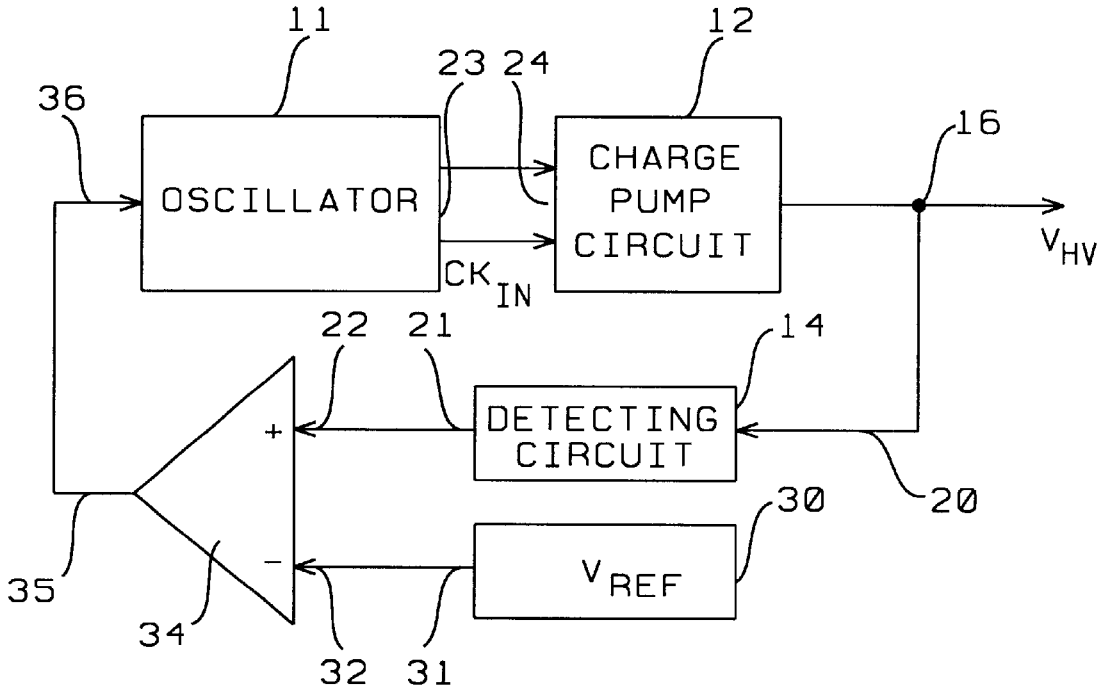
FIG. 2 – Prior Art

LOW POWER CHARGE PUMP REGULATING CIRCUIT

BACKGROUND OF THE INVENTION (1) Field of the Invention

This invention relates to a circuit for regulating the output voltage of a charge pump circuit and more particularly to using current feedback to provide analog control of the frequency of clock signals driving the charge pump circuit.

(2) Description of the Prior Art

Charge pump circuits are frequently used in EEPROM, Electronically Erasable and Programmable Read Only Memory, Circuits. These circuits supply the high voltages needed for erasing and reprogramming the Read Only Memories. These high voltages must be regulated in order to provide the proper voltages for the required application.

Many of the regulating methods used require a voltage reference and a voltage comparator which have the undesirable attribute of consuming extra power.

U.S. Pat. No. 5,553,030 to Tedrow et al. describes a charge pump circuit using comparator circuit comprising a differential amplifier circuit.

U.S. Pat. No. 5,812,017 to Golla et al. describes a charge pump voltage multiplier circuit using a voltage comparator.

U.S. Pat. No. 5,483,486 to Javanifard et al. describes a charge pump circuit using a voltage reference, a divider circuit, and a voltage controlled oscillator in regulating the output voltage.

U.S. Pat. No. 5,394,365 to Tsukikawa, U.S. Pat. No. 5,671,179 to Javanifard, and U.S. Pat. No. 5,781,473 to Javanifard et al. describe charge pump circuits.

U.S. Pat. No. 5,726,944 to Pelley et al. describe a charge pump circuit using a voltage regulation circuit comprising a band-gap voltage source.

U.S. Pat. No. 6,177,828 to Kang et al. describes a charge pump circuit wherein the voltage regulation is achieved by halting and restarting the charge pumping operation.

SUMMARY OF THE INVENTION

Charge pump circuits are frequently used to supply the higher voltages required for electronically erasing and writing EEPROM, Electronically Erasable Programmable Read Only Memory, circuits. The output voltage of the charge pump circuit must be regulated to maintain the proper voltage over the required range of operating load conditions. It is important to keep the power consumed by these voltage regulating circuits as low as possible.

FIG. 1 shows an example of a conventional means for providing voltage regulation for a charge pump circuit. FIG. 1 shows a block diagram of a conventional voltage regulated charge pump circuit showing a current controlled oscillator 10 driven by a constant current generator 28. The constant current generator 28 is connected to a primary voltage supply, $V_{DD}$, and supplies a current to the input 26 of the current controlled oscillator 10. The current controlled oscillator 10 produces clock signals, $CK_{IN}$, at clock outputs 23 which are fed to the clock inputs 24 of the charge pump circuit 12. FIG. 1 shows two clock outputs and two clock inputs for two clock signals however the actual number of clock outputs, clock inputs, and clock signals may be more than two or less than two. The clock frequency of the clock signals $CK_{IN}$ determine the output voltage, $V_{HV}$, appearing at the output 16 of the charge pump circuit 12.

The output 16 of the charge pump circuit 12 is fed to the input 20 of a detecting circuit 14 which serves as a voltage divider producing a voltage proportional to voltage at the output 16 of the charge pump circuit 12 at the output 22 of the detecting circuit 14. The output 22 of the detector circuit 14 is connected to the gate of an NMOS transistor 18 connected between the output 16 of the charge pump circuit 12 and ground potential. When the voltage at the output 16 of the charge pump circuit 12 becomes too high the voltage at the output 22 of the detecting circuit 14 turn on the NMOS transistor 18 and the current through the NMOS transistor 18 decreases the voltage at the output 16 of the charge pump circuit 12 until the voltage at the output 22 of the detecting circuit 14 drops and the current in the NMOS transistor 18 is reduced or turned off. This varying current in the NMOS transistor 18 provides voltage regulation for the charge pump circuit 12 but has the disadvantage of the power consumed by the NMOS transistor 18.

FIG. 2 shows another example of a conventional means for providing voltage regulation for a charge pump circuit 12. FIG. 2 shows a block diagram of a conventional voltage regulated charge pump circuit showing an oscillator 11 controlled by a differential amplifier 34. The oscillator 11 produces clock signals, $CK_{IN}$, at the clock outputs 23 of the oscillator 11 which are fed to the clock inputs 24 of the charge pump circuit 12. FIG. 2 shows two clock outputs and two clock inputs for two clock signals, however the actual number of clock outputs, clock inputs, and clock signals may be more than two or less than two. The clock frequency of the clock signals $CK_{IN}$ determine the output voltage, $V_{HV}$, appearing at the output 16 of the charge pump circuit 12.

The output 16 of the charge pump circuit 12 is fed to the input 20 of a detecting circuit 14 which serves as a voltage divider producing a voltage proportional to voltage at the output 16 of the charge pump circuit 12 at the output 22 of the detecting circuit 14. The output 21 of the detector circuit 14 is connected to a first input 22 of the differential amplifier 34. The output 31 of a reference voltage source 30 is connected to a second input 32 of the differential amplifier 34. The output 35 of the differential amplifier 34 is connected to the control input 36 of the oscillator 11. When the voltage at the output 21 of the detecting circuit 14, supplied to the first input 22 of the differential amplifier 34, is less than the voltage supplied by the reference voltage source 30 to the second input 32 of the differential amplifier 34, the signal at the output 35 of the differential amplifier 34, fed to the control input 36 of the oscillator, turns the oscillator 11 on. When the oscillator 11 is on, the oscillator 11 supplies clock signals, $CK_{IN}$, to the input 24 of the charge pump circuit 12, and the voltage at the output 16 of the charge pump circuit 12 increases. When voltage at the output 21 of the detecting circuit 14, supplied to the first input 22 of the differential amplifier 34, is greater than the voltage supplied by the reference voltage source 30 to the second input 32 of the differential amplifier 34, the signal at the output 35 of the differential amplifier 34, fed to the control input 36 of the oscillator 11, turns the oscillator 11 off. When the oscillator 11 is turned off clock signals, $CK_{IN}$, are no longer supplied to the inputs 24 of the charge pump circuit 12, and the voltage at the output 16 of the charge pump circuit 12 decreases. This turning the oscillator on and off provides voltage regulation for the charge pump circuit 12 but has the disadvantages of the need to supply a reference voltage source, the need for a differential amplifier, and of the fluctuation of the voltage at the output 16 of the charge pump circuit 12 caused by turning the oscillator on and off.

It is a primary objective of this invention to provide voltage regulation for a charge pump circuit using analog control of a current controlled oscillator without the need for a reference voltage supply.

It is another primary objective of this invention to provide voltage regulation for a charge pump circuit using analog control of a current controlled oscillator without the need for a reference voltage supply over the full range of the output voltage of the charge pump circuit.

It is another primary objective of this invention to provide voltage regulation for a charge pump circuit using analog control of a current controlled oscillator without the need for a reference voltage supply when the output voltage of the charge pump circuit exceeds a critical output voltage.

These objectives are achieved using a constant current generator and a second current generator controlled by the output voltage of the charge pump circuit to supply a current controlled oscillator. The current controlled oscillator supplies clock signals to the charge pump circuit. The current from the constant current generator is divided between the input to the current controlled oscillator and the second current generator. The frequency of the clock signals is a second frequency when the current to the current controlled oscillator is equal to the full current supplied by the constant current generator and decreases as the current to the input of the current controlled oscillator decreases to a first frequency as the current to the current controlled oscillator becomes zero.

When the output voltage of the charge pump circuit increases the current in the second current generator increases, the current flowing into the current controlled oscillator decreases, the frequency of the clock signals decreases, and the output voltage of the charge pump circuit decreases. When the output voltage of the charge pump circuit decreases the current in the second current generator decreases, the current flowing into the current controlled oscillator increases, the frequency of the clock signals increases, and the output voltage of the charge pump circuit increases. This provides smooth voltage regulation for the voltage at the output of the charge pump circuit without the need for differential amplifiers or a reference voltage supply.

BRIEF DESCRIPTION OF THE DRAWINGS

FIG. 1 shows a block diagram of a first conventional voltage regulation circuit for a charge pump.

FIG. 2 shows a block diagram of a second conventional voltage regulation circuit for a charge pump.

DESCRIPTION OF THE PREFERRED EMBODIMENTS

Figure 3:
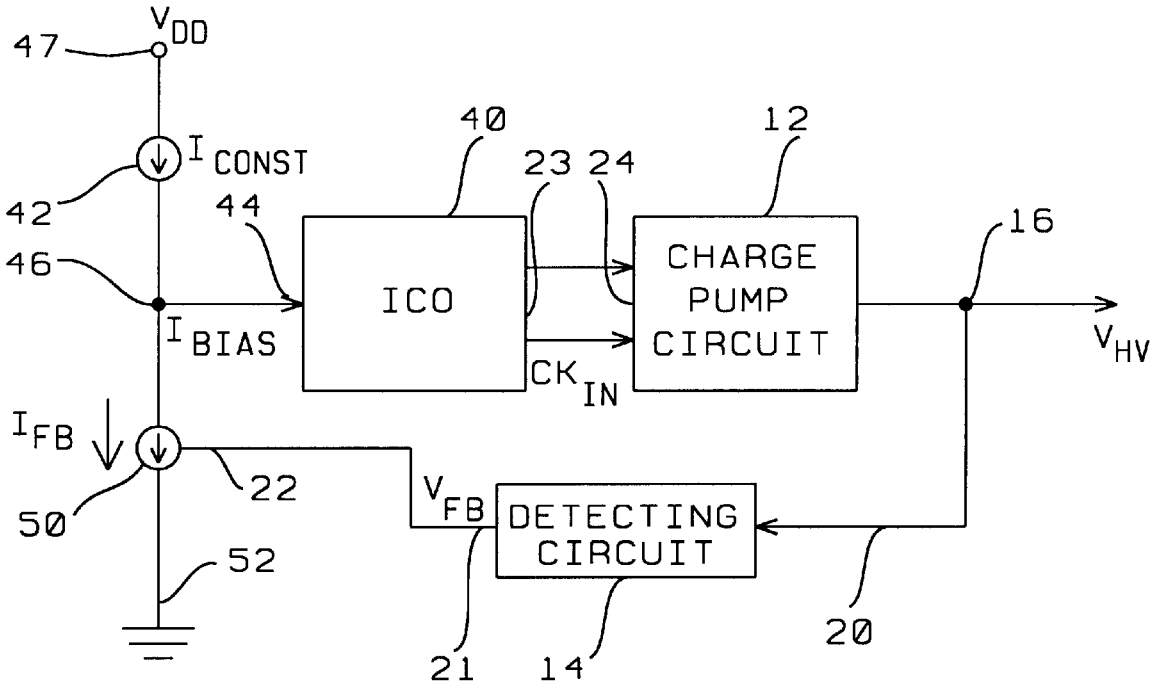
FIG. 3 shows a block diagram of a first embodiment of the charge pump voltage regulation circuit of this invention.

Refer now to FIGS. 3–8 for a description of the charge pump voltage regulating circuit of this invention. FIG. 3 shows a block diagram of the voltage regulating circuit of this invention. FIG. 3 shows a charge pump circuit 12 having clock inputs 24 and an output 16. The high voltage produced by the charge pump circuit 16 appears at the output 16 of the charge pump circuit 12. The clock inputs 24 are connected to clock outputs 23 of a current controlled oscillator 40. Clock signals produced at the outputs of the current controlled oscillator 40 are fed to the clock inputs 24 of the charge pump circuit 12. Although two clock outputs 23 of the current controlled oscillator and two inputs 24 to the charge pump circuit 12 are shown in FIG. 3, those skilled in the art will readily recognize that the number of clock outputs 23 from the current controlled oscillator 40, the number of inputs to the charge pump circuits 12, and the number of clock signals produced at the clock outputs 23 of the current controlled oscillator 40 may be less than two or more than two.

Figure 4:
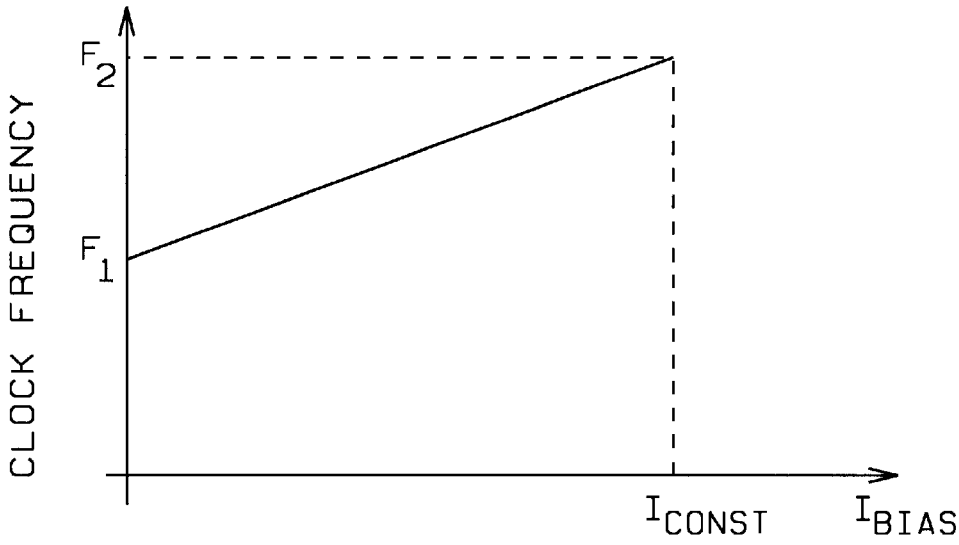
FIG. 4 shows a curve of the frequency of the clock signals as a function of the current into the current controlled oscillator.

All of the clock signals have the same clock frequency which is controlled by the bias current, $I_{BIAS}$, flowing into the bias current input 44 of the current controlled oscillator 40. FIG. 4 shows a curve of clock frequency as a function of the bias current, $I_{BIAS}$. The high voltage, $V_{HV}$, produced by the charge pump circuit 12 appears at the output 16 of the charge pump circuit, as shown in FIG. 3. This high voltage, $V_{HV}$, is determined by the clock frequency and increases as the clock frequency increases.

The output 16 of the charge pump circuit 12 is fed to the input 20 of a detecting circuit 14 having an input 20 and a feedback output 21. The detecting circuit 14 produces a feedback voltage, $V_{FB}$, at the output 21 of the detecting circuit 14 which is proportional to the high voltage, $V_{HV}$, at the output 16 of the charge pump circuit 12. The feedback voltage, $V_{FB}$, is equal to A multiplied by the high voltage, $V_{HV}$, where A is a constant between zero and one. Typical values for A are between about 0.2 and 0.5.

As shown in FIG. 3 a first current generator 42 is connected between a first node 47 and a second node 46 and produces a constant current, $I_{CONST}$. The first node 47 is connected to a primary voltage supply, $V_{DD}$. The primary voltage supply, $V_{DD}$, is typically between about 2.25 and 5.5 volts. The first current generator 42 feeds a constant current, $I_{CONST}$, into the second node 46. A second current generator 50, connected between the second node 46 and a third node 52, feeds a feedback current, $I_{FB}$, from the second node into the third node 52. The third node 52 is held at ground potential. The bias current, $I_{BIAS}$, is then the feedback current, $I_{FB}$, produced by the second current generator 50 subtracted from the constant current produced by the first current generator 42, $I_{CONST}$. The feedback current, $I_{FB}$, is determined by the feedback voltage, $V_{FB}$, produced at the feedback output 21 of the detecting circuit 14 which is fed to the feedback input 22 of the second current generator 50.

An increase in the high voltage, $V_{HV}$, produced at the output 16 of the charge pump circuit 12 increases the feedback voltage, $V_{FB}$, fed to the feedback input 22 of the second current generator 50 which increases the current, $I_{FB}$, produced by the second current generator 50. This increase in the current, $I_{FB}$, produced by the second current generator 50 decreases the bias current, $I_{BIAS}$, flowing into the current controlled oscillator 40 which decreases the clock frequency and thereby the high voltage, $V_{HV}$, at the output 16 of the charge pump circuit 12. A decrease in the high voltage, $V_{HV}$, produced at the output 16 of the charge pump circuit 12 decreases the feedback voltage, $V_{FB}$, fed to the feedback input 22 of the second current generator 50 which decreases the current, $I_{FB}$, produced by the second current generator 50. This decrease in the current, $I_{FB}$, produced by the second current generator 50 increases the bias current, $I_{BIAS}$, flowing into the current controlled oscillator 40 which increases the clock frequency and thereby the high voltage, $V_{HV}$, at the output 16 of the charge pump circuit 12.

In this manner changes in the high voltage at the output 16 of the charge pump circuit 12 changes the current produced by the second current generator 50. The changes in the current produced by the second current generator 50 produce changes in the bias current flowing into the bias current input 44 of the current controlled oscillator 40 which acts to restore the voltage at the output 16 of the charge pump circuit 12 to the desired value and voltage regulation is achieved.

As shown in FIG. 4 the current, $I_{BIAS}$, at the bias input of the current controlled oscillator varies between zero and the current, $I_{CONST}$, produced by the first current generator. The clock signals have a first frequency, $F_1$, when the current, $I_{BIAS}$, at the bias input of the current controlled oscillator is zero and a second frequency, $F_2$, when the current, $I_{BIAS}$, at the bias input of the current controlled oscillator is equal to the current, $I_{CONST}$, produced by the first current generator. In all of the embodiments of this invention the circuit and circuit operation is exactly the same as just described except for the second current generator 50.

Figure 5:
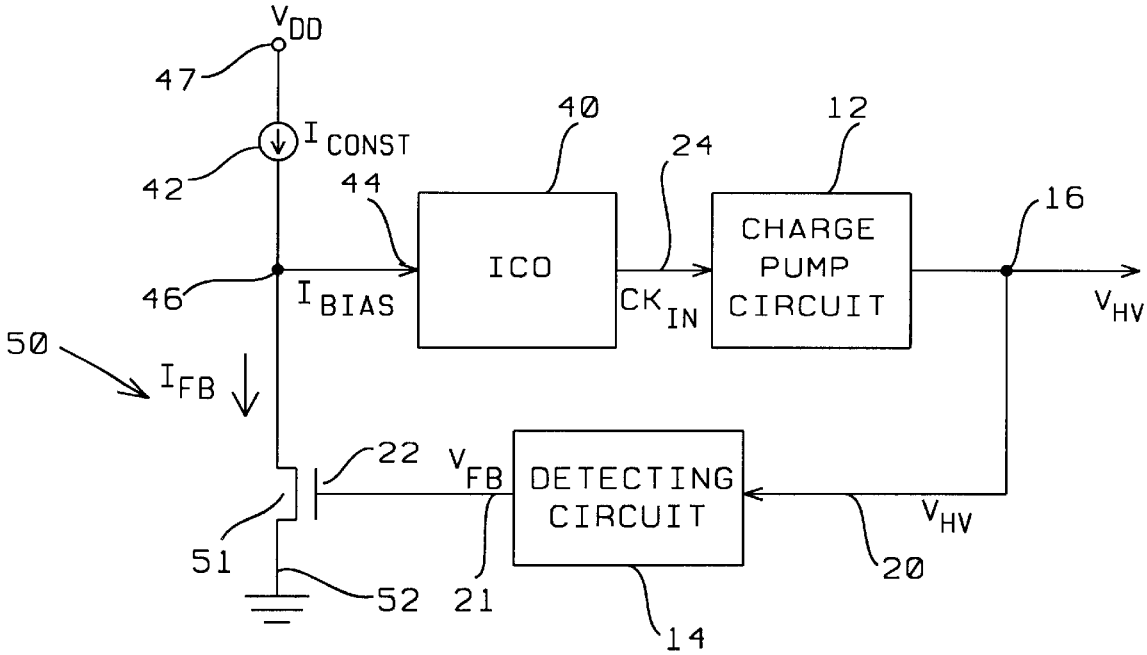
FIG. 5 shows a block diagram of a second embodiment of the charge pump voltage regulation circuit of this invention.
Figure 6:
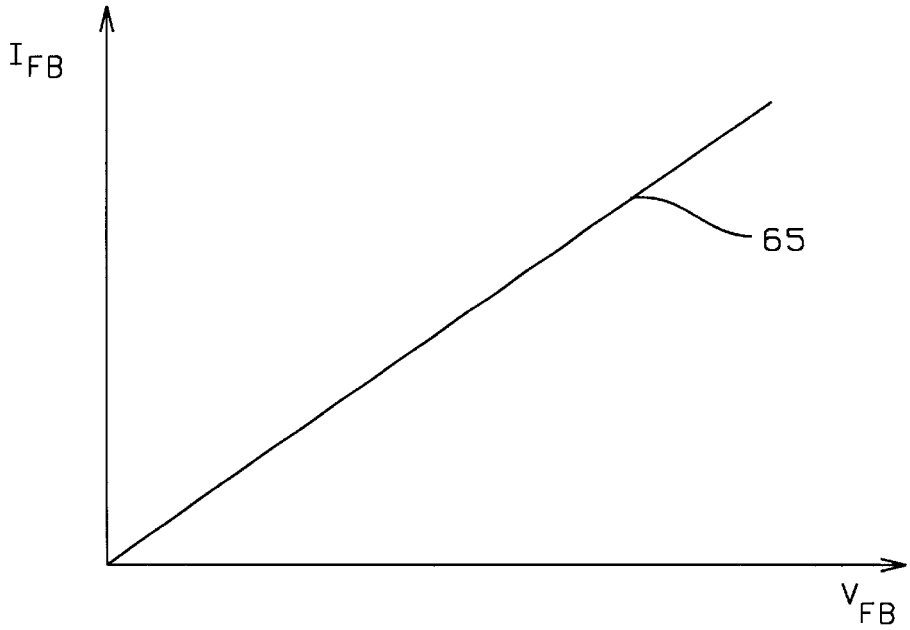
FIG. 6 shows a curve of the current into the current controlled oscillator as a function of the voltage at the feedback input of the second current generator for the second embodiment of this invention.

A second embodiment of this invention is shown in FIG. 5. In this embodiment the second current generator 50 comprises an NMOS, N channel metal oxide semiconductor field effect, transistor 51 wherein the gate input is the feedback input 22 of the second current generator 22 which is connected to the feedback output 21 of the detecting circuit 14. The source of the NMOS transistor 51 is connected to the second node 46 and the drain of the NMOS transistor 51 is connected to the third node 52 which is held at ground potential. In this embodiment the feedback current, $I_{FB}$, flowing through the second current generator is proportional to the feedback voltage, $V_{FB}$, at the feedback output of the detecting circuit, as shown by the curve 65 in FIG. 6. As previously described the feedback voltage, $V_{FB}$, at the feedback output of the detecting circuit is proportional to the high voltage output, $V_{HV}$, at the output of the charge pump circuit.

Figure 7:
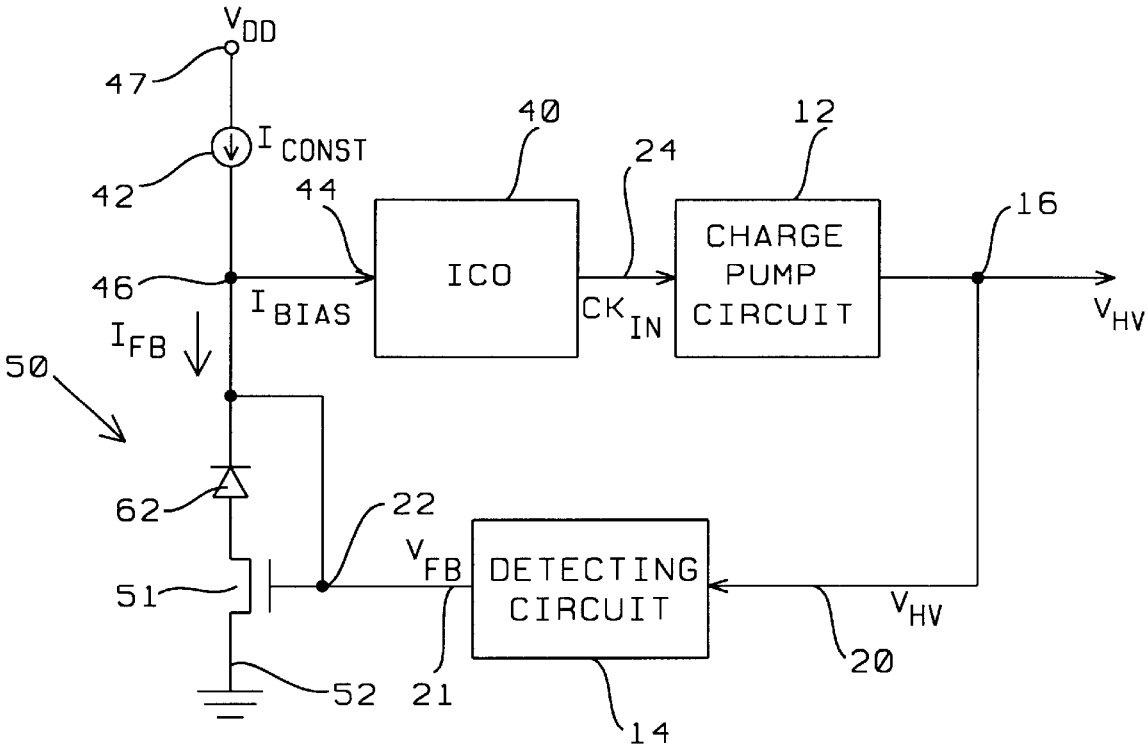
FIG. 7 shows a block diagram of a third embodiment of the charge pump voltage regulation circuit of this invention.
Figure 8:
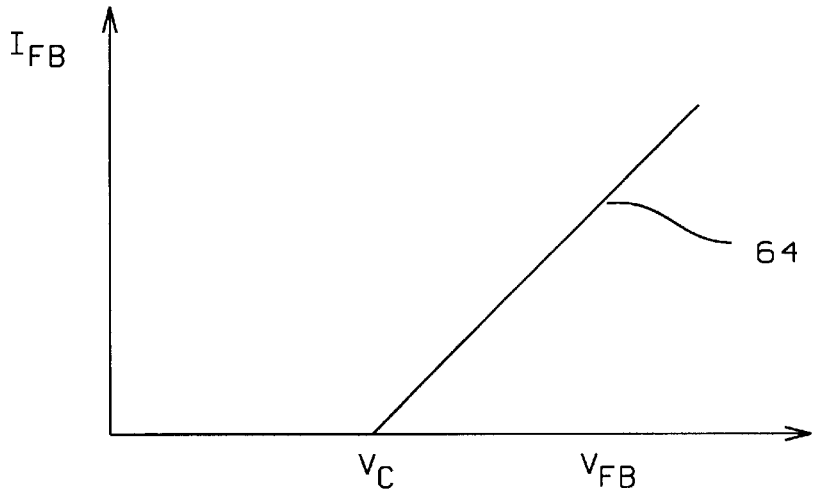
FIG. 8 shows a curve of the current into the current controlled oscillator as a function of the voltage at the feedback input of the second current generator for the third embodiment of this invention.

A third embodiment of this invention is shown in FIG. 7. In this embodiment the second current generator 50 comprises an NMOS, N channel metal oxide semiconductor field effect, transistor 51 and a diode 62. The gate of the NMOS transistor 51 is connected to the cathode of the diode 62 and is the feedback input 22 of the second current generator 22 which is connected to the feedback output 21 of the detecting circuit 14. The cathode of the diode 62 and the gate of the NOMS transistor are also connected to the second node 46. The source of the NMOS transistor 51 is connected to the anode of the diode 62 and the drain of the NMOS transistor 51 is connected to the third node 52 which is held at ground potential. In this embodiment the feedback current, $I_{FB}$, flowing through the second current generator is zero when the feedback voltage, $V_{FB}$, is below a critical voltage, $V_C$, and is proportional to the quantity of the critical voltage, $V_C$, subtracted from the feedback voltage, $V_{FB}$, at the feedback output of the detecting circuit, as shown by the curve 64 in FIG. 8. As previously described the feedback voltage, $V_{FB}$, at the feedback output of the detecting circuit is proportional to the high voltage output, $V_{HV}$, at the output of the charge pump circuit. In this embodiment no voltage regulation occurs until the high voltage output, $V_{HV}$, at the output of the charge pump circuit reaches a particular value of the critical voltage, $V_C$, divided by A, where A is the previously described constant of proportionality between the feedback voltage, $V_{FB}$, at the feedback output of the detecting circuit and the high voltage, $V_{HV}$, at the output of the charge pump circuit.

While the invention has been particularly shown and described with reference to the preferred embodiments thereof, it will be understood by those skilled in the art that various changes in form and details may be made without departing from the spirit and scope of the invention.

What is claimed is:

1. A charge pump voltage regulating circuit, comprising:

a charge pump circuit having clock inputs and a high voltage output wherein an output voltage is produced at said high voltage output of said charge pump circuit;

a detecting circuit having an input and an output wherein said input of said detecting circuit is in electrical communication with said high voltage output of said charge pump circuit, a feedback voltage is produced at said output of said detecting circuit, and said feedback depends on to said output voltage;

a first current generator in electrical communication with a primary voltage supply wherein said first current generator produces a constant first current;

a second current generator in electrical communication with said first current generator wherein said second current generator has a feedback input in electrical communication with said output of said detecting circuit, said second circuit generator produces a second current, and said second current is controlled by said feedback voltage;

an oscillator circuit having a bias current input and clock outputs wherein said bias current input is in electrical communication with said first and second current generators so that a third current equal to said second current subtracted from said first current flows into said bias current input, and each of said clock outputs are in electrical communication with one of said clock inputs of said charge pump circuit;

clock signals wherein one of said clock signals is produced at each of said clock outputs of said oscillator circuit, each of said clock signals has the same clock frequency, said clock frequency is controlled by said third current, and said output voltage produced at said high voltage output of said charge pump circuit is controlled by said clock frequency.

2. The charge pump voltage regulating circuit of claim 1 wherein said second current generator comprises an N channel metal oxide semiconductor field effect transistor.

3. The charge pump voltage regulating circuit of claim 1 wherein said second current generator comprises a diode and an N channel metal oxide semiconductor field effect transistor.

4. The charge pump voltage regulating circuit of claim 1 wherein said feedback voltage is equal to K multiplied by said output voltage wherein K is a constant.

5. The charge pump voltage regulating circuit of claim 4 wherein K is between zero and one.

6. The charge pump voltage regulating circuit of claim 1 wherein said feedback voltage is between about 0.2 and 0.5 multiplied by said output voltage.

7. The charge pump voltage regulating circuit of claim 1 wherein said clock frequency is equal to the sum of a first frequency and a constant multiplied by the quantity of said first frequency subtracted from a second frequency.

8. The charge pump voltage regulating circuit of claim 1 wherein said second current is A multiplied by said feedback voltage where A is a constant expressed in units of amps per volt.

9. The charge pump voltage regulating circuit of claim 1 wherein said second current is zero if said feedback voltage is less than or equal to a critical feedback voltage and B multiplied by the difference between said feedback voltage and said critical feedback voltage if said feedback voltage is greater than said critical feedback voltage wherein B is a constant expressed in units of amps per volt.

10. The charge pump voltage regulating circuit of claim 1 wherein said primary voltage supply supplies a voltage of $V_{DD}$.

11. The charge pump voltage regulating circuit of claim 10 wherein said $V_{DD}$ is between about 2.25 and 5.5 volts.

12. A charge pump voltage regulating circuit, comprising:

a first node wherein said first node is connected to a primary voltage supply;

a second node;

a third node wherein said third node is at ground potential;

a charge pump circuit having clock inputs and a high voltage output wherein an output voltage is produced at said high voltage output of said charge pump circuit;

a detecting circuit having an input and an output wherein said input of said detecting circuit is connected to said high voltage output of said charge pump circuit, a feedback voltage is produced at said output of said detecting circuit, and said feedback voltage is directly proportional to said output voltage;

a first current generator connected to said first node and said second node wherein said first current generator produces a constant first current flowing from said first node to said second node;

a second current generator connected to said second node and said third node wherein said second current generator has a feedback input connected to said output of said detecting circuit, said second circuit generator produces a second current flowing from said second node to said third node, said second current is equal to A multiplied by said feedback voltage, and A is a constant expressed in units of amps per volt;

an oscillator circuit having a bias current input and clock outputs wherein said bias current input is connected to said second node, a third current equal to said second current subtracted from said first current flows from said second node into said bias current input, and each of said clock outputs are connected to one of said clock inputs of said charge pump circuit;

clock signals wherein one of said clock signals is produced at each of said clock outputs of said oscillator circuit, each of said clock signals has the same clock frequency, said clock frequency is controlled by said third current, and said output voltage produced at said high voltage output of said charge pump circuit is controlled by said clock frequency.

13. The charge pump voltage regulating circuit of claim 12 wherein said second current generator comprises an N channel metal oxide semiconductor field effect transistor having a source, a gate, and a drain wherein said source is connected to said second node, said drain is connected to said third node, and said gate is connected to said feedback input of said second current generator and to said feedback output of said detecting circuit.

14. The charge pump voltage regulating circuit of claim 12 wherein said feedback voltage is equal to K multiplied by said output voltage wherein K is a constant.

15. The charge pump voltage regulating circuit of claim 14 wherein K is between zero and one.

16. The charge pump voltage regulating circuit of claim 12 wherein said feedback voltage is between about 0.2 and 0.5 multiplied by said output voltage.

17. The charge pump voltage regulating circuit of claim 12 wherein said clock frequency is equal to the sum of a first frequency and a constant multiplied by quantity of said first frequency subtracted from a second frequency.

18. The charge pump voltage regulating circuit of claim 12 wherein said primary voltage supply supplies a voltage of $V_{DD}$.

19. The charge pump voltage regulating circuit of claim 18 wherein said $V_{DD}$ is between about 2.25 and 5.5 volts.

20. A charge pump voltage regulating circuit, comprising:

a first node wherein said first node is connected to a primary voltage supply;

a second node;

a third node wherein said third node is at ground potential;

a charge pump circuit having clock inputs and a high voltage output wherein an output voltage is produced at said high voltage output of said charge pump circuit;

a detecting circuit having an input and an output wherein said input of said detecting circuit is connected to said high voltage output of said charge pump circuit, a feedback voltage is produced at said output of said detecting circuit, and said feedback voltage is directly proportional to said output voltage;

a first current generator connected to said first node and said second node wherein said first current generator produces a constant first current flowing from said first node to said second node;

a second current generator connected to said second node and said third node wherein said second current generator has a feedback input connected to said output of said detecting circuit, said second circuit generator produces a second current flowing from said second node to said third node, and said second current is zero when said feedback voltage is less than or equal to a critical voltage and A multiplied by the quantity of said critical voltage subtracted from said feedback voltage when said feedback voltage is greater than said critical voltage wherein A is a constant expressed in amps per volt;

an oscillator circuit having a bias current input clock outputs wherein said bias current input is connected to said second node, a third current equal to said second current subtracted from said first current flows from said second node into said bias current input, and each of said clock outputs are connected to one of said clock inputs of said charge pump circuit;

clock signals wherein one of said clock signals is produced at each of said clock outputs of said oscillator circuit, each of said clock signals has the same clock frequency, said clock frequency is controlled by said third current, and said output voltage produced at said high voltage output of said charge pump circuit is controlled by said clock frequency.

21. The charge pump voltage regulating circuit of claim 20 wherein said second current generator comprises a diode having an anode and a cathode and an N channel metal oxide semiconductor field effect transistor (NMOS transistor) having a source, a gate, and a drain; and wherein said cathode of said diode and said gate of said NMOS transistor are connected to said feedback input of said second current generator, said feedback output of said detecting circuit, and said second node; said anode of said diode is connected to said source of said NMOS transistor; and said drain of said NMOS transistor is connected to said third node.

22. The charge pump voltage regulating circuit of claim 20 wherein said feedback voltage is equal to K multiplied by said output voltage wherein K is a constant.

23. The charge pump voltage regulating circuit of claim 22 wherein K is between zero and one.

24. The charge pump voltage regulating circuit of claim 20 wherein said feedback voltage is between about 0.2 and 0.5 multiplied by said output voltage.

25. The charge pump voltage regulating circuit of claim 20 wherein said clock frequency is equal to the sum of a first frequency and a constant multiplied by quantity of said first frequency subtracted from a second frequency.

26. The charge pump voltage regulating circuit of claim 20 wherein said primary voltage supply supplies a voltage of $V_{DD}$.

27. The charge pump voltage regulating circuit of claim 26 wherein said $V_{DD}$ is between about 2.25 and 5.5 volts.

* * * * *